US006026667A

United States Patent [19]

Takamoku

[11] Patent Number: 6,026,667

[45] Date of Patent: Feb. 22, 2000

[54] APPARATUS FOR MANUFACTURING A ONE END FLANGE-LESS WHEEL RIM

[75] Inventor: Sadayuki Takamoku, Kitakyushu, Japan

[73] Assignee: Topy Kogyo Kabushiki Kaisha, Tokyo, Japan

[21] Appl. No.: 09/120,194

[22] Filed: Jul. 22, 1998

Related U.S. Application Data

[62] Division of application No. 08/865,483, Jun. 2, 1997, Pat. No. 5,845,400.

[51] Int. Cl.[7] ..... B21D 15/04

[52] U.S. Cl. ..... 72/105

[58] Field of Search ..... 72/105, 106, 110; 29/894.354

[56] References Cited

U.S. PATENT DOCUMENTS

| | | | |
|---|---|---|---|
| 1,841,073 | 1/1932 | Wiles | 72/105 |
| 3,381,353 | 5/1968 | Lemmerz | 72/105 |
| 3,438,111 | 4/1969 | Wilcox | 29/894.353 |
| 3,846,886 | 11/1974 | Schrodel et al. | 29/894.354 |
| 3,995,466 | 12/1976 | Kunsman | 72/105 |
| 4,050,135 | 9/1977 | Luedi | 29/894.353 |
| 4,114,414 | 9/1978 | Goodman | 72/105 |
| 4,606,390 | 8/1986 | Shute | 301/63.1 |
| 5,027,508 | 7/1991 | Cissell, II . | |
| 5,435,633 | 7/1995 | Jaskierny | 301/63.1 |

FOREIGN PATENT DOCUMENTS

| | | |
|---|---|---|
| 093893 | 11/1983 | European Pat. Off. . |
| 1603685 | 11/1981 | United Kingdom . |
| 2297731 | 8/1996 | United Kingdom . |

*Primary Examiner*—P. W. Echols

*Attorney, Agent, or Firm*—Pillsbury Madison & Sutro LLP

[57] ABSTRACT

A method for manufacturing a one end flange-less wheel rim includes the steps of: providing a sheet of rim material having a width substantially corresponding to the developed width of a one end flange-less wheel rim to be made, curving the sheet to form a cylinder, flaring one end of the cylinder, roll-forming the flared cylinder to the desired rim configuration using roll-forming machines each including an upper roll, a lower roll and a ring, with the flange-less side end of the rim material being axially abutted against the ring, and removing a margin for machining from the flange-less side end of the rim material. In the apparatus, the ring is coupled to one of the upper roll and the lower roll.

8 Claims, 3 Drawing Sheets

#1

#2

#3

APPARATUS FOR MANUFACTURING A ONE END FLANGE-LESS WHEEL RIM

This is a division of application Ser. No. 08/865,483, filed Jun. 2, 1997, now U.S. Pat. No. 5,845,400.

BACKGROUND OF THE INVENTION

1. Field of the Invention

The present invention relates to a method and apparatus for manufacturing a one end flange-less automobile wheel rim.

2. Description of Related Art

Recently, full face automobile wheels have become fashionable. In the full face automobile wheel, the outboard flange is integrally formed in the wheel disk and the inboard flange only is integrally formed in the rim so that the connection between the rim and the disk cannot be seen from outside when the wheel is mounted to an automobile.

Conventionally, this one end flange-less wheel rim is manufactured according to a method, steps of which are illustrated in FIG. 10. In the method, first, a rim 1 having flanges 2 and 3 on opposite ends thereof is roll-formed, and then a flange 2 formed at one end of the rim is cut with a margin for machining left at the rim, and finally the flange-less end 6 of the rim is machined. In this instance, the cut flange and removed margin will be scraps 4 and 5.

However, the conventional method has the following problems:

First, since the rim material has to include a portion corresponding to the flange which is cut after forming the rim, the yield of the material is low.

Second, since scrap is generated when the axially outboard side flange is cut after forming, the scrap has to be removed, which takes a considerably amount of work and time.

Third, cutting the axially outboard side flange is conducted manually, which lengthens the cycle time of the rim manufacture and lowers productivity.

Fourth, a cutting-off tool is needed for the cutting and the cutting-off tool has to be replaced by a new one. As a result, the manufacturing cost of the wheel rim increases.

SUMMARY OF THE INVENTION

An object of the present invention is to provide a method and apparatus for manufacturing a one end flange-less wheel rim which can increase the yield of wheel rim material and does not need cutting and removal of a formed flange from the wheel rim.

A method for manufacturing a wheel rim having one flange-less end according to the present invention includes the steps of: (a) providing a flat sheet of rim material having a width suitable to provide the wheel rim having one flange-less end to be manufactured with a desired final width (b) curving said sheet of rim material and butt-welding opposite ends thereof to form a cylinder of rim material, (c) flaring one axial end of the cylinder with another axial end thereof left cylindrical, (d) roll-forming the flared cylinder to the desired rim configuration by using at least one roll-forming machine each including an upper roll, a lower roll and a ring coupled to one of the upper roll and the lower roll, with the cylindrical end of the cylinder of rim material being axially abutted against the ring; and (e) removing a margin for machining from the flange-less side end of said roll-formed cylinder of rim material.

An apparatus for manufacturing a one end flange-less wheel rim includes at least one roll-forming machine. Each roll-forming machine includes an upper roll and a lower roll, and a ring coupled to either one of the upper roll and the lower roll. A rim material to be formed is axially abutted to the ring during forming.

In the above-described method, since the provided rim material has a width corresponding to a width of a one end flange-less wheel rim, that is, does not have a portion corresponding to the flange to be cut after forming, the yield of the rim material is improved to a great extent. Further, since the manufactured rim is a one end flange-less rim, no axially outboard rim flange needs to be cut off after forming the rim. As a result, the cycle time of manufacturing the rim is shortened and the cutting-off tool for cutting the flange does not need to be prepared.

In the above-described apparatus, since the ring is provided, an axially outboard dislocation of the rim material during forming the rim is prevented so that smooth forming with a high dimensional accuracy is possible.

BRIEF DESCRIPTION OF THE DRAWINGS

The above and other optional features, and advantages of the present invention will become more apparent and will be more readily appreciated from the following detailed description of the preferred embodiments of the present invention given in conjunction with the accompanying drawings, in which.

DETAILED DESCRIPTION OF THE PREFERRED EMBODIMENTS

A method for manufacturing a one end flange-less wheel rim according to one embodiment of the present invention will be explained with reference to FIGS. 1 to 9.

At a first step (FIG. 3), a flat sheet of rim material 11 having a predetermined width corresponding to the developed width of the one end flange-less wheel rim to be made is provided. The rim material is drawn from a roll of a coiled sheet having the particular width and is cut at predetermined intervals so that each cut rim material has a length equal to the circumferential length of the rim to be made.

At a second step (FIG. 4), the flat rim material 11 is curved. The opposite ends of the curved rim material are abutted and are butt-welded to form an annular or cylindrical piece of rim material 11.

At a third step (FIG. 4), one axial end 17 of the cylindrical piece of rim material 11 is flared by a flaring machine (not shown) with the other axial end 16 of the cylindrical piece left to be substantially straight, i.e. cylindrical.

Figure 1:
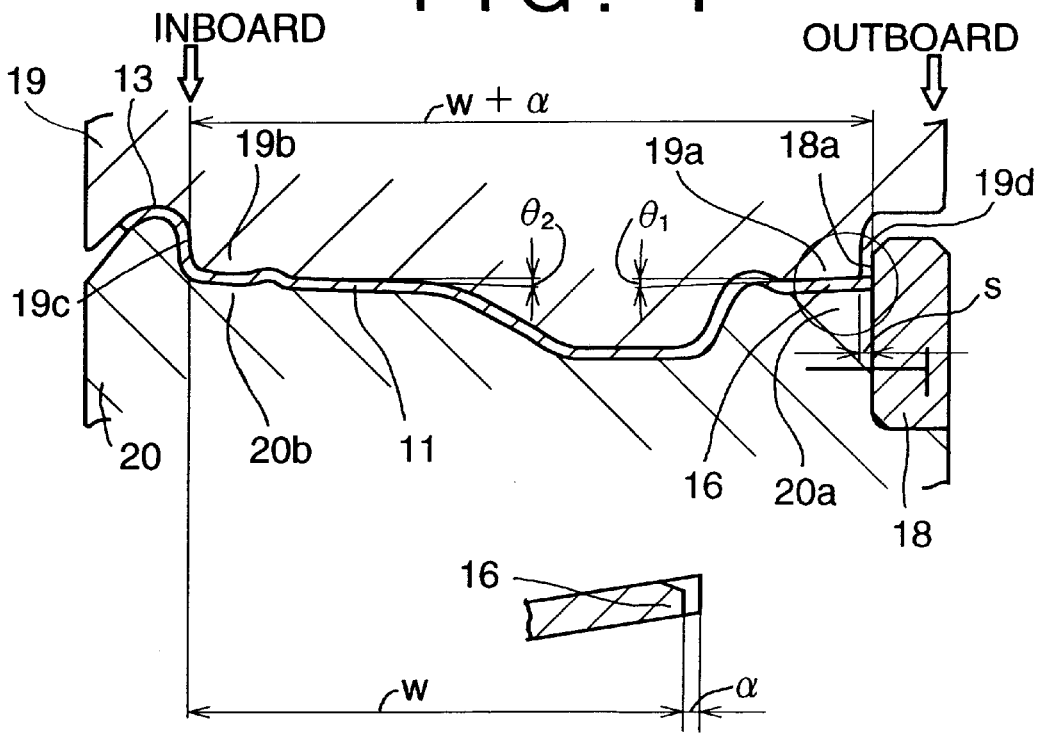
FIG. 1 is a cross-sectional view of a portion of a roll-forming machine of the rim manufacturing apparatus according to one embodiment of the present invention.
Figure 10:
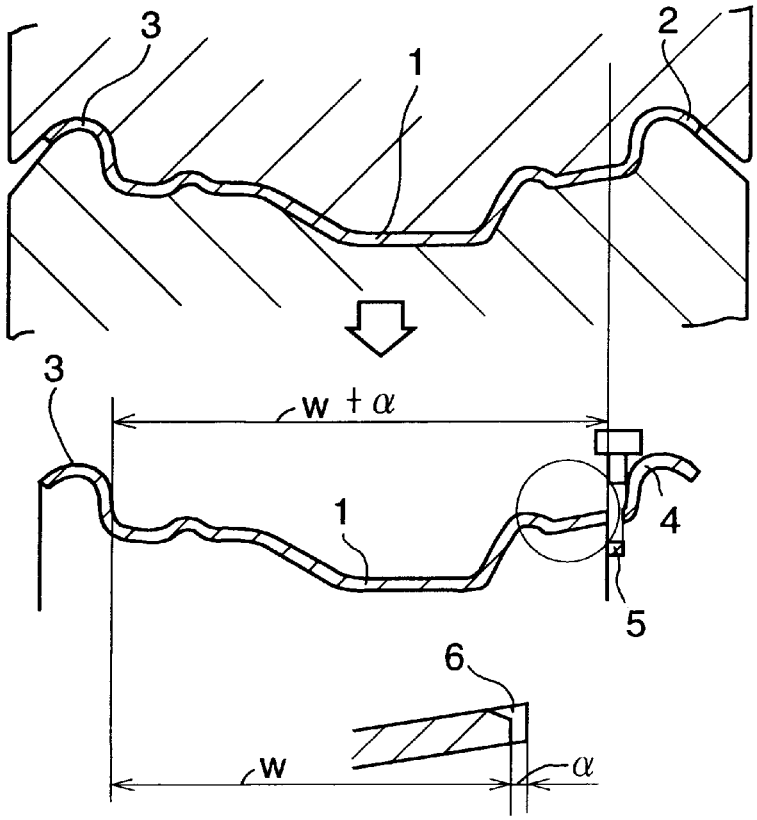
FIG. 10 (PRIOR ART)
FIG. 10 is a cross-sectional view of the rim material at each step of a method for manufacturing a one end flange-less wheel rim according to a conventional method.

At a fourth step (FIGS. 6–8), the flared rim material 11 is successively roll-formed to the desired rim configuration at a plurality of roll-forming machines (#1, #2, and #3) as shown in FIG. 1, each including an upper roll 19, a lower roll 20 and a ring 18 coupled to one of the upper roll and the lower roll with the straight, flange-less side end 16 of the rim material 11 being axially abutted against the ring 18. The roll-formed rim material 11 having the objective configuration has a flange 13 at one axial end of the rim material 11 and a flange-less end 16 at the other axial end of the rim material 11.

At a fifth step (FIG. 9), the flange-less end 16 of the roll-formed rim material 11 is machined and beveled so that the margin for machining ($\alpha$) is removed and a bevel is formed. As a result, the rim material has accurately the rim width w. The removed material pieces are scrap but do not include flange pieces unlike the conventional method.

In the above-described method, the rim material 11 is a steel plate or a light metal (for example, aluminum) plate. The margin for machining is a margin for machining the end 16 to obtain the accurate rim width in the above fifth step and is about 4 mm.

Since only one end of the rim material 11 is flared, during the successive #1, #2, and #3 roll-forming steps and in a subsequent rim configuration shaping step conducted using an expander, there may occur an imbalance in the axial direction of the rim, because the flange-less side has a smaller rigidity than the flange side. To decrease the imbalance, during the roll-forming step, especially in the #1 roll-forming step, a first rim bead seat (a portion where a tire bead is seated when the tire is mounted to the wheel) on the flange-less side is formed to have an inclination angle $\theta_0$ smaller than the inclination angle of a second rim bead seat on the flange side. The smaller the inclination angle of the rim bead seat, the more rigid is the rim bead seat, when it is roll-formed by the upper and lower rolls and is shaped to a true circle by the expander.

Further, to prevent the rim material from moving toward the flange-less side while being roll-formed, the flange-less side end 16 of the rim material 11 is abutted against the ring 18 in the axial direction of the rim material 11.

Furthermore, to prevent a flaw from being caused in the surface of the rim material during the roll-forming step, the upper roll of any of #1, #2 and #3 roll-forming machines is spaced away from the flange-less end 16 of the rim material (and the axially inboard surface of the ring 18) in the axial direction by a small distance s.

Figure 2:
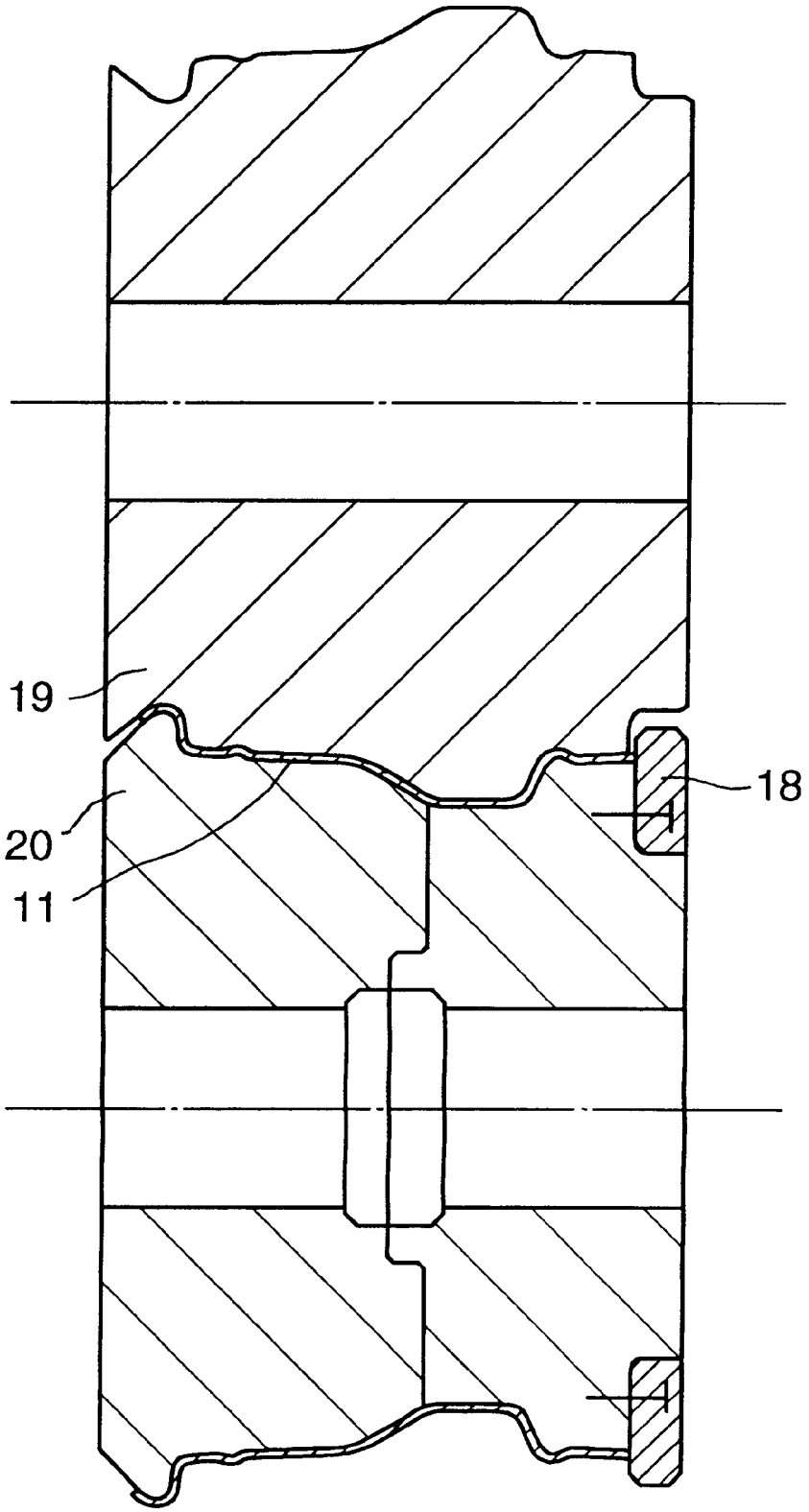
FIG. 2 is a cross-sectional view of an upper roll and a lower roll of the roll-forming machine of FIG. 1.
Figure 3:
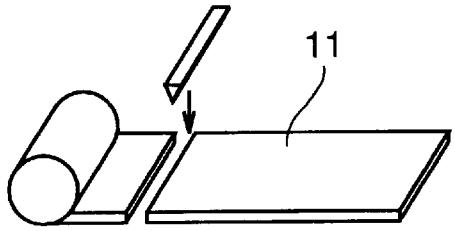
FIGS. 3–9 are a cross-sectional views of the rim material at each step of a method for manufacturing a one end flange-less wheel rim according to one embodiment of the present invention.
Figure 4:
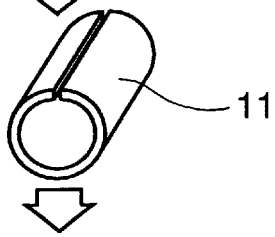
Figure 5:
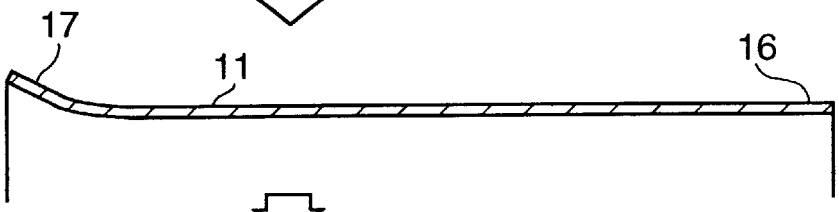
Figure 6:
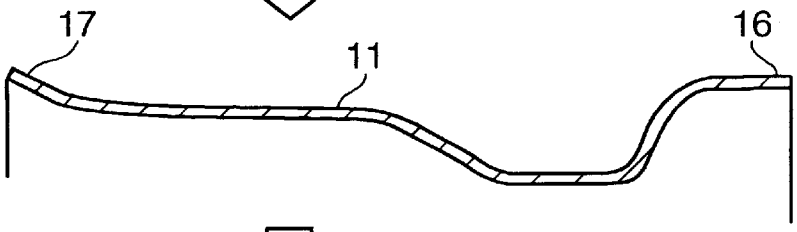
Figure 7:
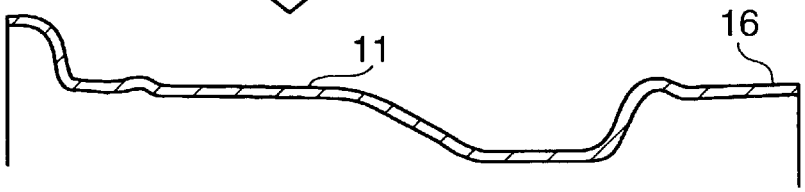
Figure 8:
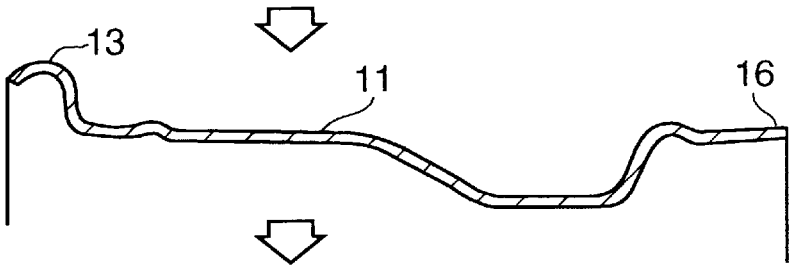
Figure 9:
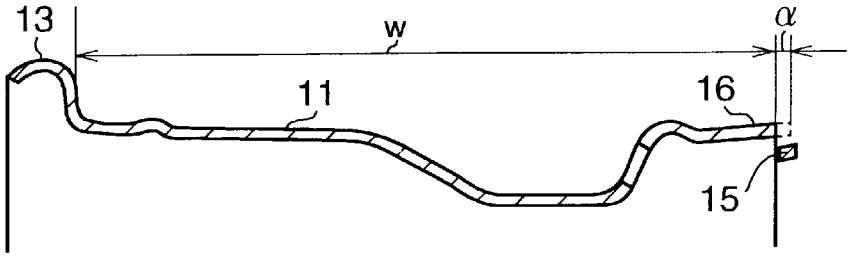

Next, the apparatus of FIGS. 1 and 2 for carrying out the above-described method will be explained more.

The apparatus for manufacturing a one end flange-less wheel rim includes at least one (for example, #1, #2 and #3) roll-forming machine. Each roll-forming machine includes an upper roll 19 and a lower roll 20. A ring 18 is coupled to either the upper roll 19 or the lower roll 20. In the embodiment shown, the ring 18 is coupled to the lower roll 20. The rim material 11 to be formed is axially abutted to the ring 18 while being roll-formed so that the rim material 11 is prevented from moving toward the flange-less side while being roll-formed. A distance between the axially inboard surface of the ring 18 and the inboard flange forming surface of the upper roll 19 is set to be the sum of the rim width w and the margin ($\alpha$) for machining.

Each of the upper roll 19 and the lower roll 20 includes a first rim bead seat forming portion 19*a*, 20*a* on the flange-less side of the one end flange-less wheel rim to be formed and a second rim bead seat forming portion 19*b*, 20*b* on the flange side of the wheel rim. The first rim bead seat forming portion 19*a*, 20*a* has an inclination angle $\theta_1$ smaller than an inclination angle $\theta_2$ of the second rim bead seat forming portion 19*b*, 20*b*. The reason for this has been discussed above.

Preferably, the inclination angle $\theta_1$ of the first rim bead seat forming portion is equal to or less than half the inclination angle $\theta_2$ of the second rim bead seat forming portion. Preferably, the inclination angle $\theta_2$ of the second rim bead seat forming portion is 8–10 degrees.

The upper roll 19 has a flange forming surface 19*c*. The distance between the flange forming surface 19*c* of the upper roll 19 and the axially inboard surface 18*a* of the ring 18 is the sum of the rim width w and the margin $\alpha$ for machining.

Further, the upper roll has a side surface 19*d* spaced axially inboard from the flange-less end of the rim configuration or the axially inboard surface 18*a* of the ring 18. The reason for this has been discussed above.

By the method and apparatus of the present invention, the following technical advantages are obtained:

In the method, since the provided rim material 11 has a width substantially corresponding to the developed width of the one end flange-less wheel rim, the yield of the rim material is improved to a great extent as compared with that of the rim material for a rim having two opposite flanges. More particularly, the width of the rim material can be decreased by about 26 mm as compared with the rim material for a rim having two opposite flanges. This results in a decrease in weight by 0.84 kg per rim with respect to a rim having a diameter of 15 inch (37.5 cm). Further, since one end flange does not need to be cut, removal of scrap of the cut flange does not need to be required and a manufacturing cycle time is improved. As a result, the number of rims handled per hour is increased from twenty to one hundred and three, and the cycle time is decreased to 1/5.2 times that of the conventional method. Furthermore, since the cutting-off tool does not need to be provided, the manufacturing cost is decreased.

With the apparatus, since the ring is provided, movement of the rim material toward the flange-less side during roll forming and shaping by an expander can be prevented.

Although the present invention has been described with reference to a specific exemplary embodiment, it will be appreciated in the art that various modifications and alterations can be made to the particular embodiments shown, without materially departing from the novel teachings and advantages of the present invention. Accordingly, it is to be understood that all such modifications and alterations are included within the spirit and scope of the present invention as defined by the following claims.

What is claimed is:

1. An apparatus for manufacturing a wheel rim having a first end with a flange and a second end that is flangeless, said apparatus including at least one roll-forming machine, each roll-forming machine comprising:

an upper roll and a lower roll;

a ring coupled to either one of said upper roll and said lower roll, arranged so that a rim being roll-formed can be axially abutted against said ring at said second flangeless cylindrical end while being roll-formed.

2. An apparatus according to claim 1, wherein each of said upper roll and said lower roll includes a first rim bead seat forming portion on the flange-less side of the one end flange-less wheel rim to be formed and a second rim bead seat forming portion on the flange side of the wheel rim, said first rim bead seat forming portion having an inclination angle smaller than the inclination angle of said second rim bead seat forming portion.

3. An apparatus according to claim 2, wherein said inclination angle of said first rim bead seat forming portion is equal to or less than a half of said inclination angle of said second rim bead seat forming portion.

4. An apparatus according to claim 2, wherein said inclination angle of said second rim bead seat forming portion is 8–10 degrees.

5. An apparatus according to any one of claim 1, wherein said upper roll has a flange forming surface, and a distance between said flange forming surface of said upper roll and the axially inboard surface of said ring is the sum of the rim width of the rim to be formed and a margin for machining.

6. An apparatus according to claim 1, wherein said upper roll has a side surface spaced away axially inboardly from the axially inboard surface of said ring.

7. A wheel manufacturing apparatus for making a generally cylindrical wheel rim having a pair of opposing ends, one of said opposing ends having an annular flange and the other of said opposing ends being flangeless, said apparatus comprising:

a roll forming machine comprising:

a first rotatable roll forming element;

a second rotatable roll forming element, each of said first and second roll forming elements providing a flange forming portion;

said first and second roll forming elements being positioned with respect to one another such that a generally cylindrical blank wheel rim can be positioned therebetween and said roll forming elements can then be counter-rotated so as to cooperate with one another to shape said blank wheel rim and such that said flange forming portions cooperate to form the aforesaid annular flange; and an abutment ring positioned with respect to said first and second roll forming elements such that the end of the blank wheel rim that provides the resulting shaped wheel rim with the aforesaid flangeless end thereof can be abutted against said ring as the roll forming elements are being counter-rotated to thereby limit axial movement of the blank wheel rim in the general direction of said ring.

8. In combination with a generally cylindrical blank wheel rim, a wheel manufacturing apparatus for making a generally cylindrical wheel rim having a pair of opposing ends, one of said opposing ends having an annular flange and the other of said opposing ends being flangeless, said apparatus comprising:

a roll forming machine comprising:

a first rotatable roll forming element;

a second rotatable roll forming element each of said roll forming elements providing a flange forming portion;

said first and second roll forming elements being positioned adjacent one another and said blank wheel rim being positioned therebetween such that said roll forming elements can be counter-rotated so as to cooperate with one another to shape said blank wheel rim and such that said flange forming portions cooperate to form the aforesaid annular flange;

an abutment ring positioned adjacent said first and second roll forming elements, the end of said blank wheel rim that provides the resultant roll formed wheel rim with the aforesaid flangeless being abutted against said abutment ring to limit axial movement of the blank wheel rim in the general direction of said ring as the roll forming elements are counter-rotated.

* * * * *